US012507849B2

(12) United States Patent
Sergyeyenko et al.

(10) Patent No.: US 12,507,849 B2
(45) Date of Patent: Dec. 30, 2025

(54) VACUUM CLEANER

(71) Applicant: Black & Decker Inc., New Britain, CT (US)

(72) Inventors: Oleksiy P. Sergyeyenko, Baldwin, MD (US); Ana Garcia, Baltimore, MD (US); Mark Thomas Davies, Newcastle (GB); Graeme Crawley, Newcastle-upon-Tyne (GB)

(73) Assignee: BLACK & DECKER, INC., New Britain, CT (US)

( * ) Notice: Subject to any disclaimer, the term of this patent is extended or adjusted under 35 U.S.C. 154(b) by 190 days.

(21) Appl. No.: 17/511,714

(22) Filed: Oct. 27, 2021

(65) Prior Publication Data

US 2022/0047133 A1 Feb. 17, 2022

Related U.S. Application Data

(63) Continuation of application No. PCT/EP2020/061086, filed on Apr. 21, 2020.
(Continued)

(51) Int. Cl.
*A47L 9/14* (2006.01)
*A47L 5/24* (2006.01)
(Continued)

(52) U.S. Cl.
CPC ..... *A47L 9/149* (2013.01); *A47L 5/24* (2013.01); *A47L 9/0072* (2013.01); *A47L 9/1409* (2013.01); *A47L 9/2857* (2013.01)

(58) Field of Classification Search
None
See application file for complete search history.

(56) References Cited

U.S. PATENT DOCUMENTS 4,718,140 A * 1/1988 Johnson ..... A47L 5/24 15/330
7,114,824 B2 * 10/2006 Picone ..... B25B 13/14 362/120
(Continued)

FOREIGN PATENT DOCUMENTS

DE 102012100047 A1 * 7/2013 ..... A47L 5/14
DE 102012100048 A1 7/2013
(Continued)

OTHER PUBLICATIONS

PCT International Search Report dated Jul. 13, 2020 for corresponding International Application No. PCT/EP2020/061086.
(Continued)

*Primary Examiner* — Tom Rodgers
*Assistant Examiner* — Dana Lee Poon
(74) *Attorney, Agent, or Firm* — Mannava & Kang, P.C.

(57) ABSTRACT

A vacuum cleaner comprising: a housing; a fan; a dirt collection chamber having an opening for emptying dirt from the dirt collection chamber; and a cover movable between a closed position, in which the cover seals the opening, and an open position, wherein the vacuum cleaner is configured to operate: in a suction mode in which the fan generates a suction airflow from an air inlet to an air outlet; and in a blow mode in which the fan generates a blowing airflow from the air outlet to the opening when cover is in the open position.

14 Claims, 9 Drawing Sheets

Related U.S. Application Data

(60) Provisional application No. 62/840,489, filed on Apr. 30, 2019.

(51) Int. Cl.
*A47L 9/00* (2006.01)
*A47L 9/28* (2006.01)

(56) References Cited

U.S. PATENT DOCUMENTS

| | | | | |
|---|---|---|---|---|
| 2011/0214567 | A1* | 9/2011 | McClearen | A47L 9/0081 15/327.2 |
| 2015/0135470 | A1* | 5/2015 | Mantyla | A47L 9/2873 15/301 |
| 2016/0367094 | A1* | 12/2016 | Conrad | A47L 9/16 |
| 2017/0290481 | A1* | 10/2017 | Conrad | A47L 9/322 |
| 2018/0078107 | A1 | 3/2018 | Gagnon et al. | |
| 2018/0177367 | A1* | 6/2018 | Amaral | A47L 9/102 |
| 2019/0282049 | A1* | 9/2019 | Conrad | A47L 9/1409 |

FOREIGN PATENT DOCUMENTS

| | | | |
|---|---|---|---|
| DE | 102016124786 | A1 | 7/2017 |
| EP | 0723758 | A2 * | 7/1996 |
| EP | 1913857 | B1 | 4/2011 |
| WO | 2015070322 | A1 | 5/2015 |

OTHER PUBLICATIONS

European Search Report, EP Application No. 20722247.2, dated Dec. 2, 2024, 7 pages.

* cited by examiner

VACUUM CLEANER

CROSS-REFERENCE TO RELATED APPLICATIONS

This application is a continuation of international application PCT/EP/2020/061086, filed Apr. 21, 2020 which claims priority from U.S. Provisional Patent Application No. 62/840,489, filed Apr. 30, 2019, the disclosures of which are incorporated herein by reference in their entirety.

BACKGROUND OF THE INVENTION

The present invention relates to a vacuum cleaner.

Many people use vacuum cleaners to clean and tidy their homes. There has been a trend for consumers to use cordless vacuum cleaners because they are more convenient than traditional corded vacuum cleaners when cleaning a dirty surface. Some cordless vacuum cleaners are small and light enough to be handheld vacuum cleaners which are also known has "handvacs".

Normally vacuum cleaners are used to pick up dust and debris using a negative pressure. Dust and debris is entrained in an air flow and sucked into the body of the vacuum cleaner wherein the dust and debris are separated from the air flow. The separation means may comprise one or more filters and/or a cyclonic separation device. Once separated from the air flow, the dust and debris are collected in a dirt collection chamber, which is usually emptied by the user into a dustbin when the chamber is full.

Emptying the dirt collection chamber and removing the filters for cleaning usually involves the user having to touch the dirty chamber and filters. This is undesirable for the user. Embodiments of the present invention aim to address these problems.

BRIEF SUMMARY OF THE INVENTION

According to a first aspect there is provided a vacuum cleaner comprising: a housing; a fan; a dirt collection chamber having an opening for emptying dirt from the dirt collection chamber; and a cover movable between a closed position, in which the cover seals the opening, and an open position, wherein the vacuum cleaner is configured to operate: in a suction mode in which the fan generates a suction airflow from an air inlet to an air outlet; and in a blow mode in which the fan generates a blowing airflow from the air outlet to the opening when cover is in the open position.

The air inlet may be separate from the opening. The dirt collection chamber may comprise a dirty air inlet that is separate from the opening. The collected dirt can thus be blown out of the dirt collection chamber via a different opening to the dirt inlet and/or dirty air inlet. The allows the dirt collection chamber opening to be of a different size and/or orientation to the air inlet/dirty air inlet and more suitable for emptying the dirt collection chamber in the blow mode.

According to second aspect there is provided a vacuum cleaner comprising: a housing; a fan; an air inlet, wherein, in a suction mode, dirt is sucked in through the air inlet; and an opening, wherein, in a blow mode, dirt from a dirt collection chamber is blown out of the opening, wherein the opening is greater in size than the inlet.

The air flow speed through the opening in the blow mode may be less than the air flow speed through the inlet in the suction mode. The rotational speed of the fan in the suction mode may be substantially the same as the rotational speed of the fan the blow mode. The rotation speed of the fan in the suction mode may be greater than the rotational speed of the fan in the blow mode.

The vacuum cleaner of the second aspect may further comprising a cover movable between a closed position, in which the cover seals the opening, and an open position, wherein: in the suction mode, the fan generates a suction airflow from the inlet to an air outlet; and in the blow mode, the fan generates a blowing airflow from the air outlet to the opening when cover is in the open position.

The vacuum cleaner may further comprise an actuator configured to actuate a switch for the blow mode and to actuate a mechanism for moving the cover to the open position.

According to third aspect there is provided a vacuum cleaner comprising: a housing; a fan; a dirt collection chamber having an opening for emptying dirt collected in the dirt collection chamber; a cover movable between a closed position and an open position; and an actuator configured to actuate a switch for a blow mode in which the fan generates a blowing airflow and to actuate a mechanism for moving the cover to the open position.

The actuator may be further configured to actuate the switch for a or the suction mode. The actuator may be further configured to actuate the mechanism to move the cover to a or the closed position. The mechanism may be configured to move the cover to the closed position when the blow mode is deactivated.

The actuator may be coupled to the switch and to the mechanism for moving the cover such that movement of the actuator causes both the switch and the mechanism to actuate.

The switch may comprise a button movable between a first switch position and a second switch position, the distance between the first and second switch positions being a first distance; the actuator is configured to move the button between the first and second switch positions and the actuator is movable between a first actuator position and a second actuator position, the distance between the first and second actuator positions being a second distance that is greater than the first distance.

The switch may comprise a movable button; the actuator may be configured to move within a first range of positions which causes the button to move; and the actuator may be configured to move within a second range of positions in which the button does not move. In a suction mode, the fan may generate a suction airflow from a dirt inlet to an air outlet; and in the blow mode, the fan may generate a blowing airflow from the air outlet to the opening when cover is in the open position. The size of the opening may be greater than the size of the air inlet. The fan may be an axial fan.

The housing may comprise a nozzle portion having a longitudinal axis and the fan has a rotation axis, wherein the rotation axis is offset from the longitudinal axis such that the rotation axis and the longitudinal axis are not coaxial.

According to a fourth aspect there is provided a vacuum cleaner comprising: a housing comprising a nozzle portion and an air inlet, wherein the nozzle potion has a longitudinal axis that passes through the air inlet; and an axial fan having a rotation axis, wherein the rotation axis is offset from the longitudinal axis such that the rotation axis and the longitudinal axis are not coaxial.

The rotation axis may be parallel to the longitudinal axis. The vacuum cleaner may further comprise a dirt collection chamber having an opening for emptying dirt from the dirt collection chamber, wherein the rotation axis passes through the opening.

The vacuum cleaner may further comprise a cover movable between a closed position, in which the cover seals the opening, and an open position, wherein: in the suction mode, the fan generates a suction airflow from the air inlet to an air outlet; and in the blow mode, the fan generates a blowing airflow from the air outlet to the opening when cover is in the open position. The opening may be greater in size than the air inlet. The vacuum cleaner may be a handheld vacuum cleaner.

BRIEF DESCRIPTION OF THE DRAWINGS

Various other aspects and further embodiments are also described in the following detailed description and in the attached claims with reference to the accompanying drawings, in which:

DETAILED DESCRIPTION OF THE PREFERRED EMBODIMENTS

In an embodiment of the vacuum cleaner described herein, the vacuum cleaner can operate in a suction mode or a blow mode. In the suction mode, a motor-fan generates a suction air flow to draw in dirt-laden air from an air inlet. The dirt is separated from the dirty air flow by a dirt separation apparatus and is collected in a dirt collection chamber. The cleaned air is exhausted from an air outlet. A user may activate a blow mode, in which the motor-fan generates a blowing air flow that draws air in through the air outlet and blows the dirt out of an opening in the dirt collection chamber. This allows the user to conveniently empty the dirt collection chamber without having to touch any dirty parts of the vacuum cleaner.

Figure 1:
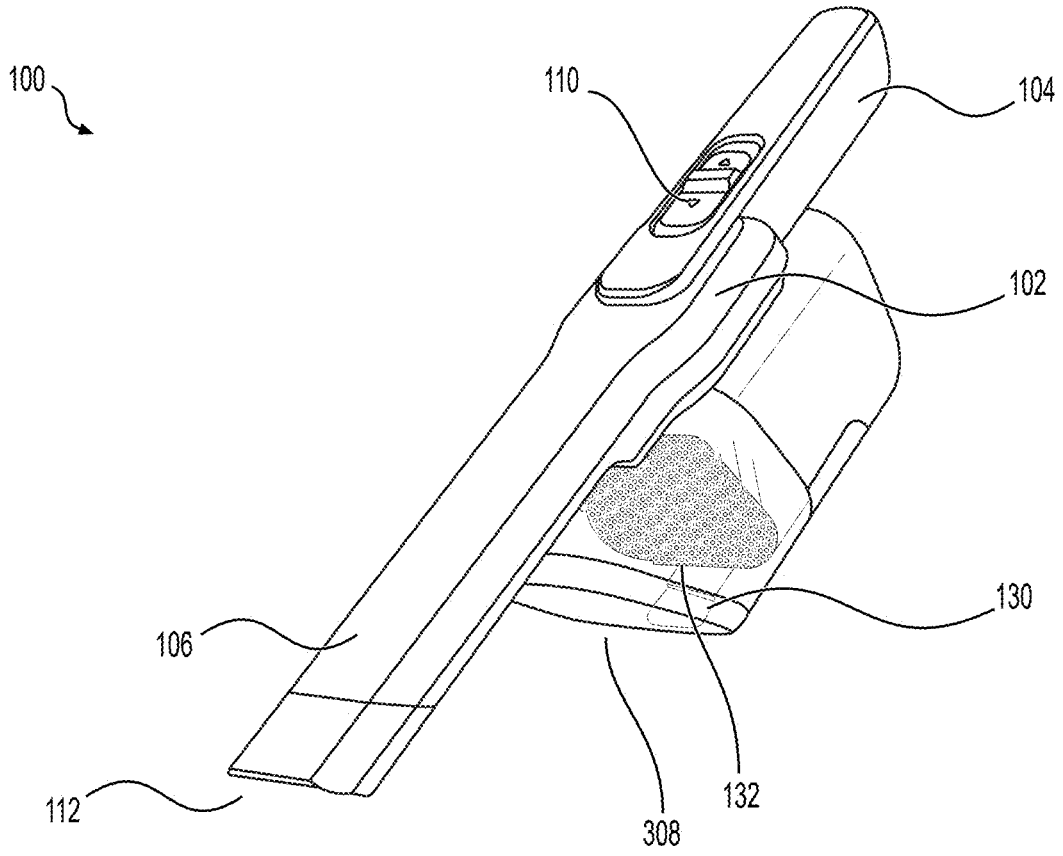
FIG. 1 shows a perspective view of a vacuum cleaner according to a first embodiment.

FIG. 1 shows a perspective view of a handheld vacuum cleaner 100. The handheld vacuum cleaner 100 as shown in FIG. 1 is a handheld vacuum cleaner (also known as a "handvac"), but in other embodiments the handheld vacuum cleaner 100 may be an upright vacuum cleaner, a stickvac, a canister vacuum cleaner or any other type of vacuum cleaner. References to vacuum cleaner 100 hereinafter will be in reference to the handheld vacuum cleaner as shown in the Figures.

The handheld vacuum cleaner 100 comprises a housing 102. The housing 102 may comprise a clam shell type construction comprising two halves which are fastened together. The halves of the housing 102 are fastened together with screws but in alternative embodiments any suitable means for fastening the housing together may be used such as glue, clips, bolts and so on. For the purposes of clarity, the fastenings in the housing 102 are not shown.

The housing 102 comprises a handle 104. The handle 104 may be integral with the housing 102 and the user grips the handle 104 when operating the handheld vacuum cleaner 100. Although not shown in the Figures, in some embodiments, the handle 104 is moveably mounted to the housing 102. In this way, the housing 102 comprises a pivot whereby the handle 104 is pivotally mounted to the housing 102. This means that the angle of the handle 104 with respect to the handheld vacuum cleaner 100 can be adjusted. This can make reaching awkward spaces such as under chairs or on top of cupboards easier. Additionally or alternatively, the handle 104 is slideable with respect to the housing 102. Accordingly, the handle 104 is extendable and means that the flexibility of the handheld vacuum cleaner 100 is increased. In some embodiments, the handle 104 is telescopic and is stowed within the housing 102 when not extended.

In some embodiments, the housing 102 comprises an actuator 110 for operating the handheld vacuum cleaner 100. The actuator 110 is coupled to a switch which turns the vacuum cleaner on or off. The actuator 110 may also control other functions or modes, such a blow mode, suction power level, or the opening and/or closing of the dust collection chamber door, as will be described further below. Alternatively, separate actuators, buttons or switches may be used to control those other modes and functions.

In other embodiments, the actuator 110 may be positioned on the handle 104. For example, the actuator 110 may comprise a sliding switch that positioned on the top surface of the handle 104 for actuation with, for example, the users thumb. In other embodiments, the actuator 110 may comprise a trigger located on the underside of the handle 104. In this way, the user's index finger can be used to actuate the trigger. In other embodiments, the actuator 110 can be located on any exterior surface of the handheld vacuum cleaner 100.

Figure 2:
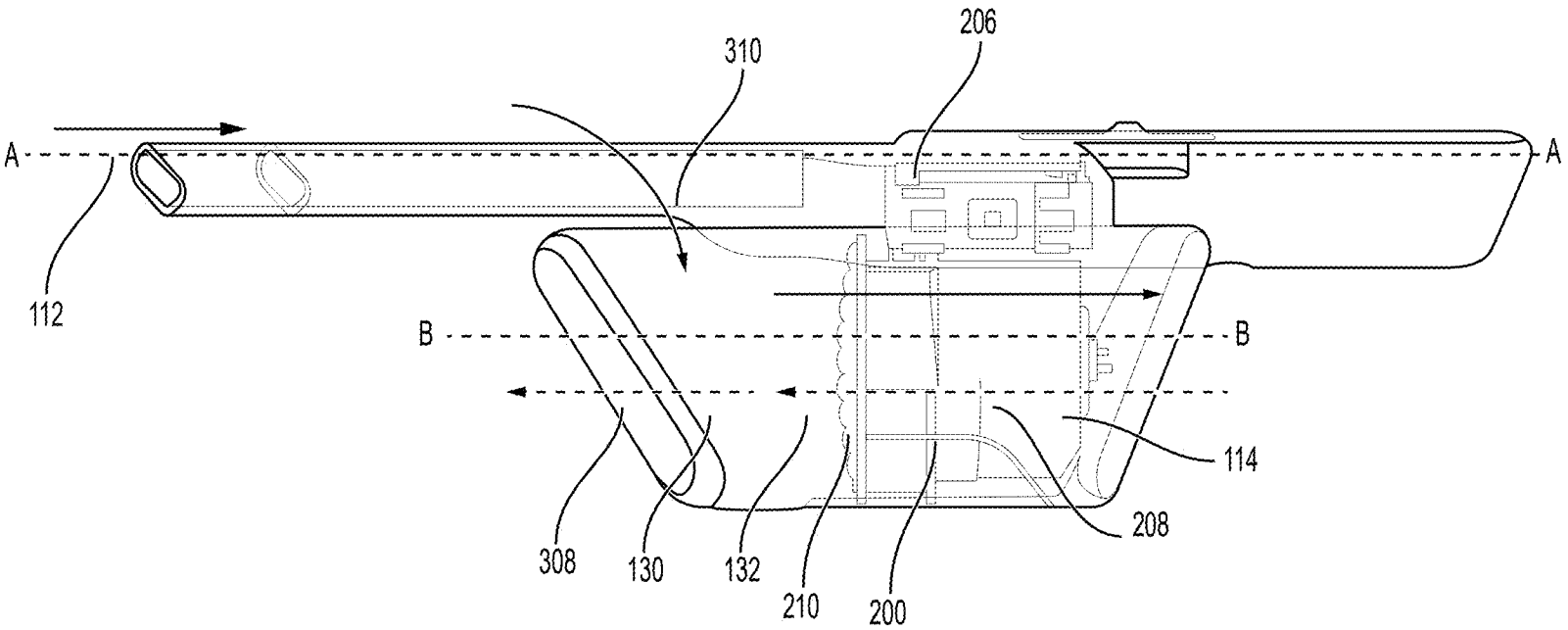
FIG. 2 shows an internal view of the vacuum cleaner.

In some embodiments, the housing 102 or handle 104 comprises indicators, such as a display (not shown), for providing information about the handheld vacuum cleaner 100 to the user. For example, the display may indicate to the user the charge level status of a battery 206 (which is best shown in FIG. 2). The display may indicate further properties of the vacuum cleaner such as the filter status (filter blocked/filter cleared) or the suction power level/mode.

The battery 206 is housed in the housing 102. In other embodiments (not shown), the battery may be housed in a battery housing which is releasably mountable to the housing 102. In this way, the battery 206 can be switched with another battery. For example, the rear of the handle 104 may have an opening, recess or a battery attachment interface which can removably receive the battery housing. The housing 102 may comprise one or more sockets (not shown) for charging the battery.

The handheld vacuum cleaner 100 comprises a generally elongate shape with a nozzle 106 extending along the longitudinal axis A-A (as shown in FIG. 2). The vacuum cleaner comprises an air inlet 112 and an air outlet 114 (shown in FIG. 2). When operating in a suction mode, the air flow path extends between the air inlet 112 and the air outlet 114 (as shown by the solid arrows in FIG. 2). The air flow paths will be discussed in further detail below. The air outlet 114 may comprise a plurality of openings mounted on housing 102, such as a grill, or slots in the housing. A filter may also be located at the air outlet to: a) in the suction mode, capture any remaining dirt in the suction air flow;

and/or b) in the blow mode, prevent any dirt or objects (external of the vacuum cleaner) entering the motor fan assembly 200.

Figure 6:
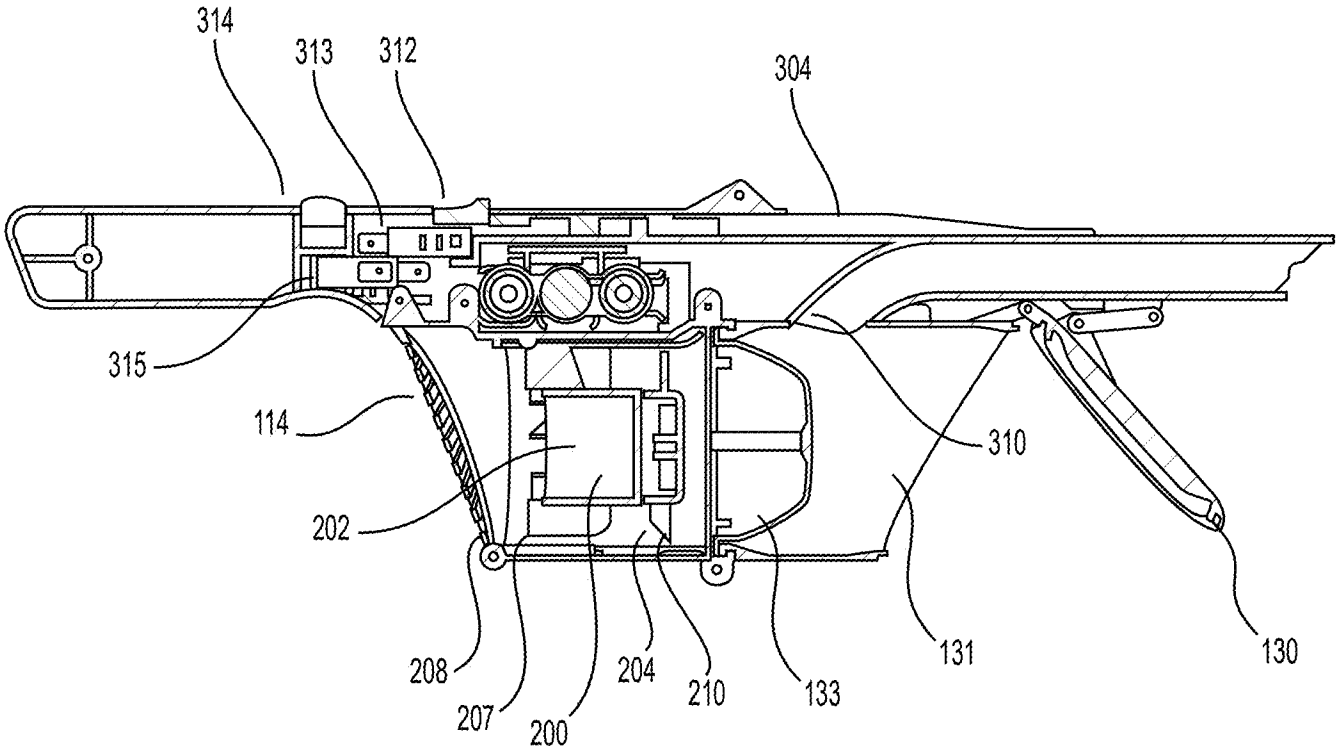
FIG. 6 shows a cross-sectional view of the vacuum cleaner.
Figure 8:
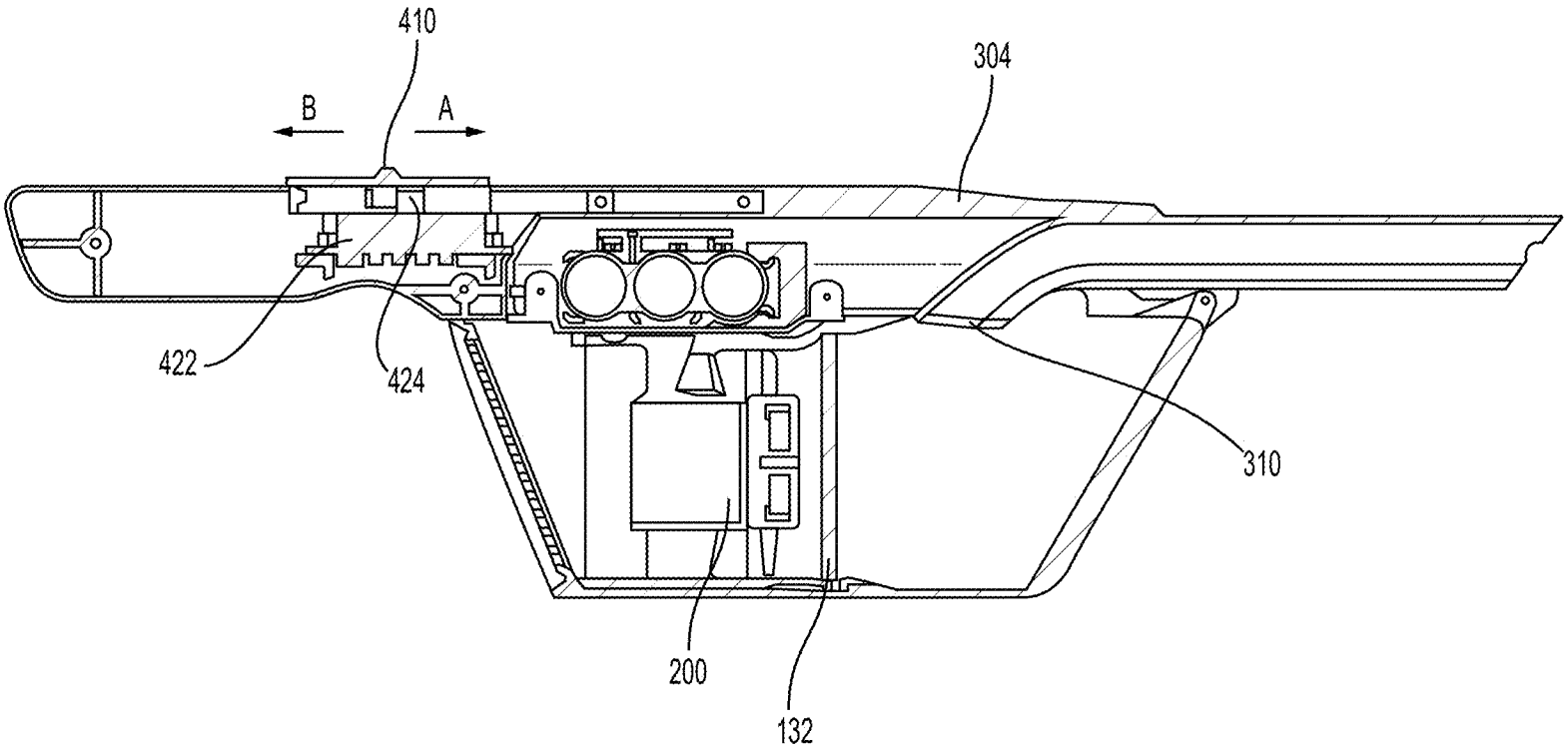
FIG. 8 shows a cross-sectionals view of the vacuum cleaner of FIG. 7.

The handheld vacuum cleaner 100 comprises a motor fan assembly 200 which is best shown in FIGS. 2, 6 and 8. FIG. 2 shows an internal view of the handheld vacuum cleaner 100, highlighting the motor fan assembly 200 and battery 206. The motor fan assembly 200 comprises a motor 202 and a fan 204 (as shown in FIGS. 6 and 8). The motor fan assembly 200 may comprise a motor cover 208 and fan shroud 210 (as shown in FIG. 2). The motor cover 208 may comprise stationary guide vanes or blades 207 to direct air through the motor fan assembly. In the suction mode, the motor fan assembly 200 generates a negative pressure for sucking up dirt and debris via the dirty air inlet 112. In the blow mode, the motor fan assembly 200 generates a positive pressure for blowing out dirt and debris from the dirt collection chamber 130 via an opening 131 in the dirt collection chamber 130, as will be described further below.

The air inlet 112 can optionally comprise a coupling engageable with a floor extension tube or other accessories (such as a flexible hose). This means that the handheld vacuum cleaner 100 can allow the user to extend the reach of the handheld vacuum cleaner 100.

In some embodiments, the motor 202 is a brushed d.c. motor. In other embodiments, the motor 202 can be a d.c. motor, an a.c. motor, or an asynchronous multiphase motor controlled by an electronic circuit (not shown). The motor 202 may be a permanent magnet brushless motor, a switched reluctance motor, a flux switching motor, or other brushless motor type, which may have a higher rotational speed than a brushed motor. The drive shaft of the motor 202 may be directly coupled to the fan 204. Alternatively, the drive shaft of the motor 202 may be coupled to the fan 204 via a gear mechanism and/or a transmission mechanism.

The motor fan assembly 200 is electrically connected to a power source. As mentioned above, the power source is a battery 206 comprising a plurality of battery cells. In some embodiments, the battery 206 is a lithium ion battery. In other embodiments, the battery 206 can be any suitable type of battery for use in a handheld vacuum cleaner 100. In other embodiments the vacuum cleaner 100 additionally or alternatively comprises a mains electricity supply (not shown).

The rotation axis of the motor fan assembly 200 is substantially parallel to the longitudinal axis A-A of the housing 102 or nozzle portion 106. In some embodiments (e.g., the embodiment of FIG. 2), the rotation axis (depicted by dashed line B-B) of the motor fan assembly 200 can be offset from the longitudinal axis of the housing 102. In such embodiments, the rotation axis B-B is not coaxial with the longitudinal axis A-A of the nozzle 106. Thus, the rotation axis B-B does not pass through or intersect the intake 112. Instead, the rotation axis B-B passes through or intersects the dust container opening 131. The rotation axis B-B may also pass through or intersects the outlet 114. In some embodiments, the rotation axis B-B may be tilted with respect to the longitudinal axis A-A (in other words, A-A and B-B are not parallel to each other).

In some embodiments, the handle may be positioned above the motor-fan assembly 200. This makes the handheld vacuum cleaner 100 easier to handle and ergonomic because the centre of gravity of the handheld vacuum cleaner 100 is close to the handle. Accordingly, there is less turning moment about the handle which makes operation of the handheld vacuum cleaner 100 more comfortable. In some embodiments, the battery 206 is located within or under the handle. This keeps the centre of gravity of the handle vacuum cleaner 100 close to the handle 104. In other embodiments, the battery and/or motor can be arranged such that the centre of gravity is slightly forward of the handle. This causes the vacuum cleaner to tip slightly forwards and downwards towards the surface to be cleaned which makes operation of the handheld vacuum cleaner 100 more comfortable for the user. In another embodiment, the battery (e.g., a removable battery) is located at or near the rear of the handle 104 and the motor is located at or near the front of the handle such that the handle is 104 is between the battery and the motor. Since the battery is usually a heavy component, positioning it at the rearmost position in the vacuum cleaner balances the vacuum cleaner around the handle.

A dirt collection chamber (or dirt container) 130 is mounted on the housing 102. The dirt container 130 is arranged to receive dirt or debris which is separated from the dirty air flow received from the air inlet 112 during suction operation.

The dirt container 130 comprises an external wall which forms part of the external surface of the handheld vacuum cleaner 100. In some embodiments, the dirt container 130 may be releasably mountable to the housing 102. In other embodiments, the dirt container 130 may be non-removable from the housing 102.

The dirt container 130 comprises a releasable door or lid 308 for emptying the dirt container 130. The door 308 is hinged on the dirt container 130. In this way, the door 308 is coupled to the dirt container 130 with a pivot. The door 308 can pivot with respect to an opening 131 in the dirt container 130. This means that the door 308 can be moved from a secured closed position to an open position (as demonstrated in FIGS. 4, 5 and 6). In the closed position, the opening is sealed by the door such that no air can flow through the opening when the vacuum cleaner is operating in the suction mode. In the open position, the dirt container 130 is emptiable in a dustbin or other receptacle.

In an embodiment, a user may manually move the door 308 between the open and closed positions. The door 308 can be secured to the dirt container 130 with a catch mechanism. In some embodiments the catch is a living hinge with a hook portion which is integral with the door 308 and arranged to couple with a reciprocal recess. Alternatively, the catch mechanism can comprise a spring biased lever which is releasable when the user depresses one end of the lever and a hook portion lifts up from the door 308. The lever may be secured to the housing 102 or the dirt container 130. In other embodiments, any other suitable mechanism can be used for selectively releasing the door 308 from the dirt container 130. For example, any arrangement of clips, clamps, hooks, latches, catches etc can be used. In other embodiments, the door may be automatically opened and/or closed via a door actuation mechanism, as will be described further below.

The door 308 and/or the perimeter of the opening 131 may comprise a seal (not shown) around its periphery. The seal can be made from rubber, silicone or any other suitable material for sealing the surfaces. This provides an air tight seal between the door and the dust container 130 when the door is in the closed position. Alternatively, the door 308 is pressed firmly against the dust container 130 when the door is in the closed position to create a seal therebetween.

In some embodiments, at least a portion of the dirt container 130 is translucent or transparent so that the user can see the status of the dirt container 130. This makes it easier for the user to know when to empty the dirt container 130. In some embodiments, the entire dirt container 130 is translucent or transparent.

In other embodiments, the dirt container 130 is releasably removeable from the housing 102 such that the dirt container 130 can be completely removed from the housing 102. This means that the dirt container 130 can be removed and washed separately from the handheld vacuum cleaner 100. For example, this allows the user to wash the dirt container 130 under a tap or in a dishwasher. The dirt container 130 may be slidably mountable on the housing 102 or have a press-fit mounting or have any other suitable mechanism for removably securing it to the housing 102.

The handheld vacuum cleaner 100 inherently has a directionality in normal use. In this way, the "front" of the vacuum cleaner 100 is at the end corresponding to the dirty air inlet 112. Likewise, the "rear" 134 of the handheld vacuum cleaner 100 is the end of the handheld vacuum cleaner 100 corresponding to the end with the handle 104. Accordingly, the handheld vacuum cleaner 100 has a top side and a bottom side.

The dirt container 130 comprises a container air inlet 310 (as shown in FIGS. 2, 6 and 8) which is in fluid communication with the air inlet 112, via nozzle portion 106. The container air inlet 310 receives the dirty air from the dirty air inlet 112 and guides the air flow into the dirt container 130. In some embodiments, the container air inlet 310 may be tangential to the inner wall of the dirt container 130 to create a cyclonic air flow or swirling air flow around container. The dirt container 130 comprises a container air outlet in fluid communication with the fan 204. A dirt separation apparatus, such as filter 132, is provided at the container air outlet (as shown in FIGS. 2 and 8). In other embodiments, the filter can be provided between the container air outlet and the fan 204, or adjacent to the container air outlet (e.g., just within the dirt container 130 or at the fan shroud 210 opening). The filter 132 may be a bag filter, pleated filter, foam filter or any other suitable filter type. Preferably, a flexible filter such as a bag filter is implemented. The flexible filter may be placed over a rigid filter frame. An example of a filter frame 133 is shown in FIG. 6 (the flexible filter is not shown for clarity). When the vacuum cleaner is operating in the suction mode, the flexible filter presses against the filter frame 133 due to the suction air flow. When the vacuum cleaner is switched to the blow mode, the blowing air flow causes the flexible filter to flex away from the filter frame, which causes dirt and dust on the filter to be flicked away from the filter and towards the opening. This helps to further remove dust and dirt from the flexible filter compared to a rigid filter. The filter 132 may be removable from the vacuum cleaner so that it can be washed.

The air flow in the suction mode is shown by the solid arrows in FIG. 2. In the suction mode, the motor 202 rotates the fan 204, which drives air out of the air outlet 114. This in turn creates a suction which draws dirty air through the dirty air inlet 112 where it is introduced into the dirt container 130 through the container air inlet 310. The dirty air passes over the outer surface of the filter 132, and particles of dirt and debris are deposited in the collection chamber 130. Partially cleaned air passes through the filter 132, where finer dirt is trapped. The filtered air then passes through the fan shroud 210 and the motor housing 208. The clean air passes over (and/or through) the motor 202 to cool it. The air exits the vacuum cleaner via outlet 114.

The air flow in the blow mode is shown by the dashed arrows in FIG. 2. In the blow mode, the fan 204 generates an airflow in an opposite to the direction to the suction mode. In an embodiment, the fan 204 may be an axial fan which rotates in a first direction to generate the suction air flow and in a second, opposite direction to generate the blow air flow. The direction of rotation of the fan 204 may be switched by switching the direction of rotation of the motor 202 shaft. Alternatively, a gear mechanism may be used to switch the direction of rotation of the fan. In other embodiments, the fan 204 may be a mixed flow or multi-stage fan or any other fan type or fan arrangement which can generate air flows for the suction and blow modes.

In the blow mode, the door 308 is open (although FIG. 2 shows the door 308 in the closed position) and the fan 204 rotates to drive air out of the opening in the dirt container 130. This in turn draws air in through the air outlet 114 and passes over or through the motor 202. The air flow blows particles of dirt and debris that are in the dirt container 130 out of the opening 131. Thus, the dirt container 130 is emptied in the blow mode. The air flow also dislodges and blows the fine dirt in the filter 132 into the dirt container 130 and out of the opening 131. Thus, the filter 132 is cleaned in the blow mode. The blow mode thus allows the user to easily and conveniently empty the dirt container 130 and clean the filter 132 without having to touch the dirt or dirty components. The user can place the vacuum cleaner over a dustbin or other receptacle so that when the blow mode is activated, the dust and dirt is emptied straight into the dustbin.

In the blow mode, the air exits through the opening 131 rather than through the air inlet 112 because the path via the opening 131 has lower resistance than the path via the inlet 112. The path via the opening 131 has a lower resistance because it is straight and the cross-sectional area of the path (i.e., the dirt container 131) is larger than the cross-sectional area of the path via the inlet 112 (i.e., nozzle 106). The air inlet 112 is separate or remote from the opening 131. Optionally, a one-way valve which allows air to flow in the suction direction only could be located at the inlet 112 or the container inlet 310 to further ensure that dust is only blown out of the opening 131 and not out of the inlet 112.

In the suction mode, the inlet 112, dirt container 130 and filter 131 are upstream of the fan 204 and the motor 202 and the outlet 114 are downstream of the fan 202. In the blow mode, the outlet 114 and motor 202 are upstream of the fan 204 and the dirt container 130 and the opening 131 are downstream of the fan 202. The inlet 112 is not in the air flow path in the blow mode.

The size of the opening 131 is larger than the size of the air inlet 112. In other words, the size of the area formed by the perimeter of the opening 131 is greater than the size of the area formed by the perimeter of the air inlet 112. The cross-sectional area of the dirt container 130 may correspond to the area of the opening 131. For a given fan speed in the blow mode, increasing the cross-sectional area of the opening 131 reduces the airflow velocity through the opening 131. A reduced airflow velocity is advantageous as a high airflow velocity in the blow mode causes dirt and dust to be ejected at high speed which creates a dust cloud when emptying. By reducing the airflow velocity, the dirt and dust is ejected at a lower speed and so the dust cloud is avoided or minimised.

In other embodiments, instead of the opening 131 shown in the figures, the dirt container may be connectable to a dirt outlet such as hose or other suitable attachments which directs dirt and dust out of the dirt container in the blow mode. The dirt outlet is separate to the inlet 112. The dirt outlet may direct dirt to a dustbin or receptacle and may be larger in size than the air inlet so that the air flow velocity is reduced in the blow mode, as described above.

The air flow velocity or speed through the opening 131 or dirt outlet in the blow mode is less than the air flow speed through the inlet 112 in the suction mode. The air flow speed through the opening 131 can be reduced by providing an opening 131 or dirt outlet that is larger in size than the inlet 112, as described above, even when the rotation speed of the fan 204 is substantially the same (but in opposite directions) in the suction and blow modes. Additionally or alternatively, the rotation speed of the fan 204 in the blow mode may be less than the rotation speed of the fan in the suction mode.

The suction mode or blow mode may be activated by an actuator, such as the slidable button 104 shown in FIG. 1. In the embodiment of FIG. 1, a user may slide the actuator 104 to: a) a first position to activate the suction mode; b) a second position to turn the vacuum cleaner off or to a standby state; and c) a third position to activate the blow mode. The actuator 104 may be coupled to an electrical switch (not shown) which activates the blow or suction modes depending on the position of the actuator 104. In another embodiment, the actuator may comprise two or more separate buttons that the user may, e.g., press to select between the suction and blow modes and standby/off.

In the embodiment shown in FIGS. 1 and 2, to operate the vacuum cleaner in the suction mode, the user manually closes door 308 and activates the suction mode by moving the actuator 104 to the appropriate position. To operate the vacuum cleaner in the blow mode, the user manually opens door 308 and activates the blow mode by moving the actuator 104 to the appropriate position. In the embodiments described below in relation to FIGS. 3-9, when the user actives the blow mode, the door is automatically opened and so the user does not need to manually move the door. Optionally and additionally, the when the user actives the suction mode, the door may automatically close so the user does not need to manually move the door.

Figure 3:
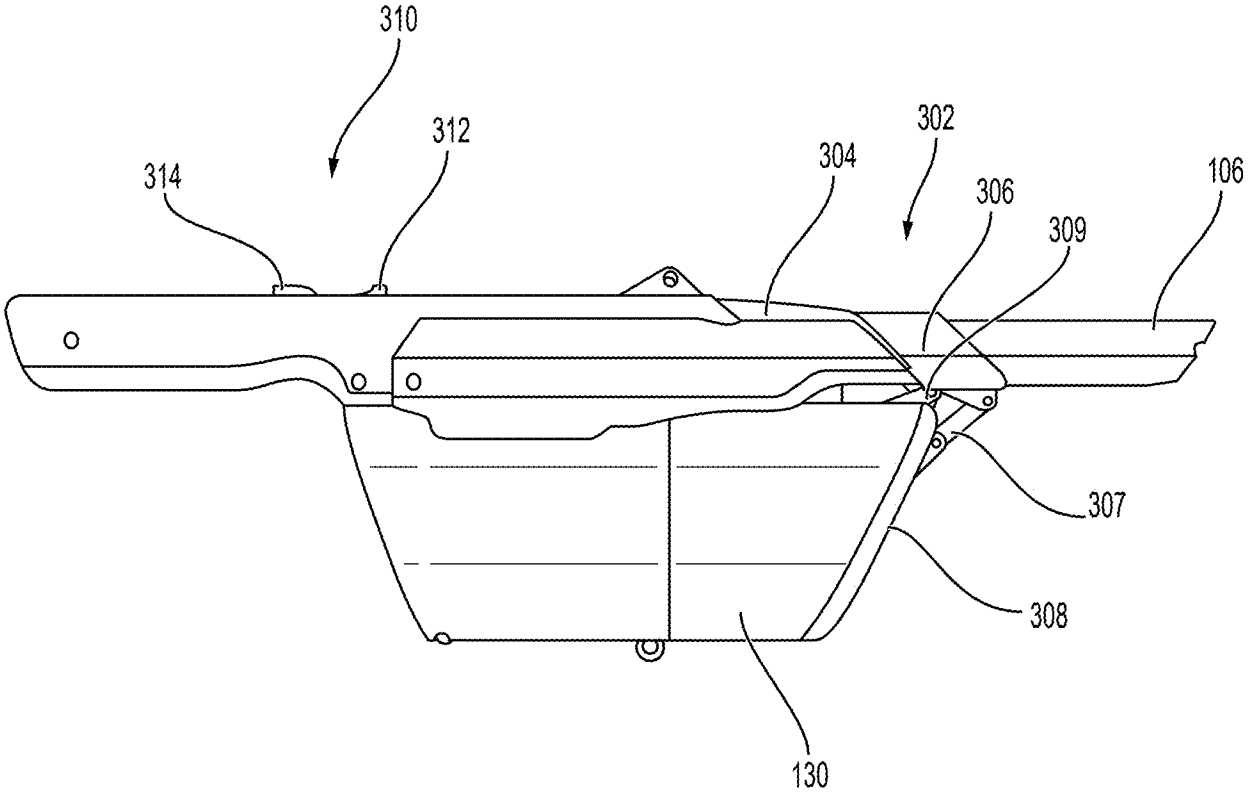
FIG. 3 shows a side view of a vacuum cleaner with a door mechanism and the door in a closed position.
Figure 4:
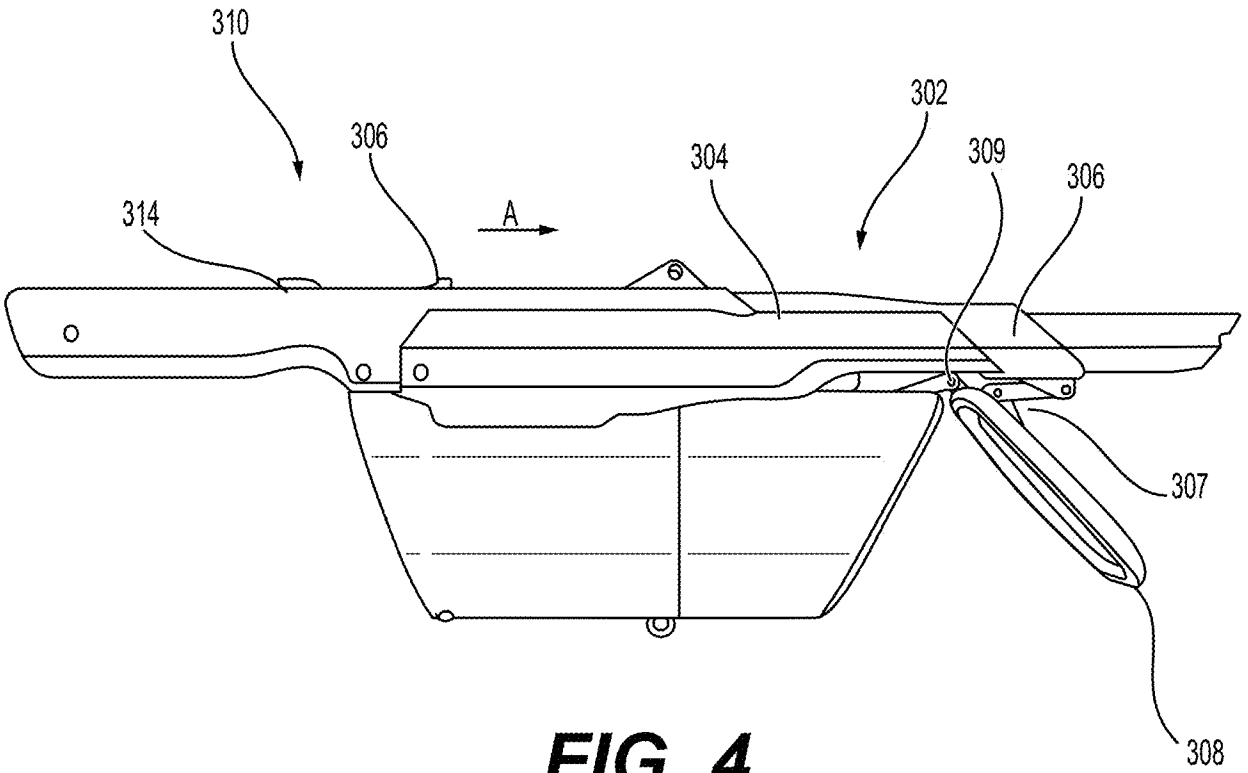
FIG. 4 shows a side view of the vacuum cleaner of FIG. 3 with the door in the open position.
Figure 5:
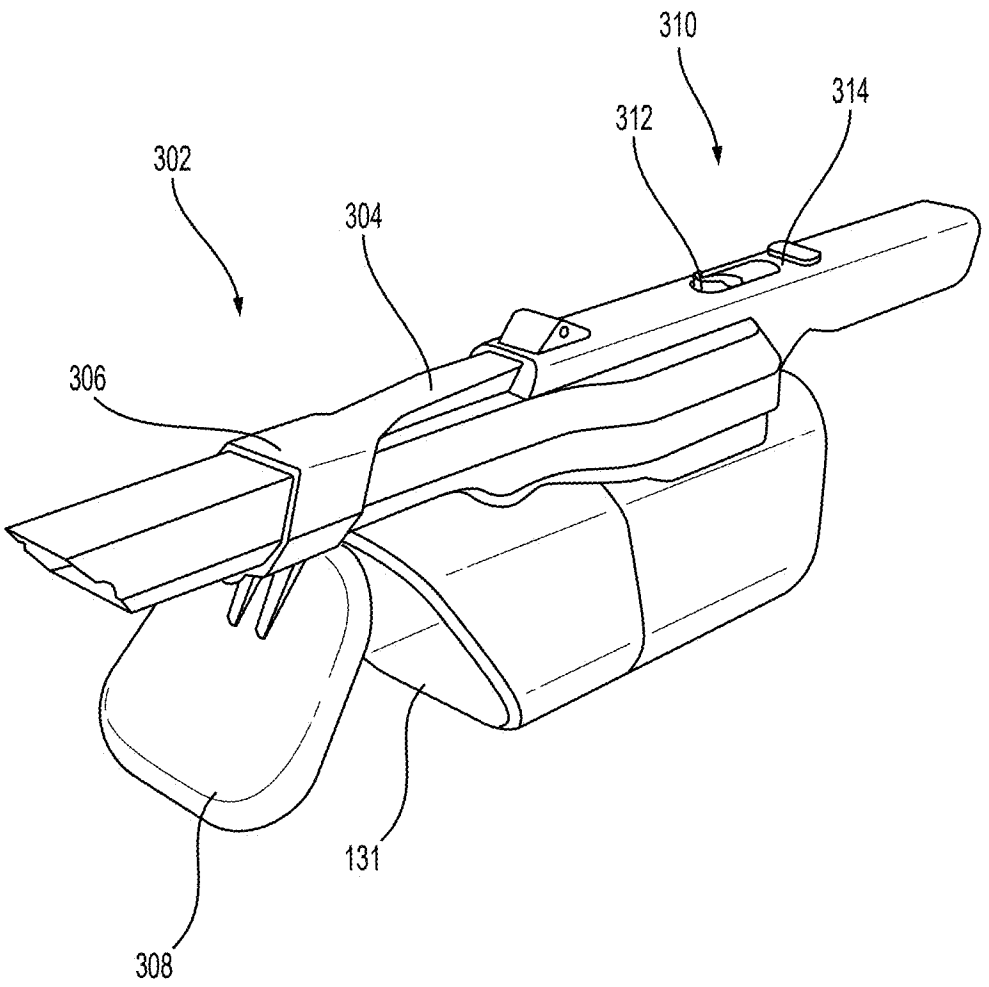
FIG. 5 is a perspective view of the vacuum cleaner of FIG. 4.

FIGS. 3-6 show a vacuum cleaner that is similar to the vacuum cleaners of the previous embodiments but with an automatic door mechanism 302. The mechanism 302 comprises an arm 304, a collar 306 and a pivoting arm arrangement 307. The collar 306 may wrap around the nozzle 106 to mechanically couple the arm 304, which is above the nozzle 106, to the pivoting arm arrangement 307, which is below the nozzle 106. The arm 304 is coupled to an actuator 310. The actuator 310 comprises a slidable button 312 and a pressable button 314. The arm 304 is coupled to or is formed together with the collar 306. When the slidable button 312 is in a first position, as shown in FIG. 3, the arm 304 and collar 306 are positioned such that the pivoting arm arrangement 307 pushes the door 308 so that it pivots about hinge 309 to the closed position. When the slidable button 312 is pushed to the second position, as shown in FIGS. 4, 5 and 6, the button 312 pushes the arm 304 in the direction indicated by arrow A, which in turn moves the collar 306 in the same direction. This movement causes the pivoting arm 307 to pull the door 308 so that it pivots about hinge 309 to the open position, as shown in FIGS. 4, 5 and 6.

The slidable button 312 may actuate a first switch 313 and the pressable button may actuate a second switch 315. When the slidable button 312 is pushed to the second position, the first switch 313 is actuated and the blow mode is activated. Thus, pushing the slidable button 312 to the second position activates the blow mode and actuates the door mechanism to automatically open door 308. FIG. 6 shows the slidable button 312 in the second position. This means that the blow mode can only be activated when the door 308 is in the open position. The vacuum cleaner may comprise a controller (not shown), which automatically deactivates the blow mode after a predetermined amount of time from activating the blow mode.

When the slidable button 312 is pulled back from the second position to the first position, the blow mode is deactivated. When the slidable button 312 is moved back towards the first position from the second position, the slidable button 312 no longer actuates the first switch 313 and so the blow mode is deactivated. Moving the sliding button 312 back to the first position causes the door mechanism to move the door to the closed position. Thus, pulling the slidable button 312 to the first position deactivates the blow mode and actuates the door mechanism to automatically close door 308. The door mechanism 302 may comprise a spring (not shown) to bias the mechanism 302 towards the closed door position. Thus, when the user releases the slidable button 312 from the second position, the biased door mechanism 302 will push the slidable button 312 back to the first position. Alternatively or additionally, the slidable button 312 may comprise a spring to bias the button 312 to the first position.

Button 314 can be depressed to activate the suction mode. A second switch 315 is actuated when button 314 is depressed. Actuating the second switch 315 activates the blow mode. In an embodiment, if both the first and second switches 313 and 315 are actuated at the same time, the motor 202 is deactivated (e.g., via a controller) and the vacuum cleaner turns off or goes into standby mode. The vacuum cleaner is re-activated when only one of the switches is actuated. In another embodiment, button 314 may only be depressed when the sliding bottom 312 is in the first position. When the sliding button 312 is in the second position to activate the blow mode, button 314 is locked out from being depressed so that the suction mode cannot be activated.

Figure 7:
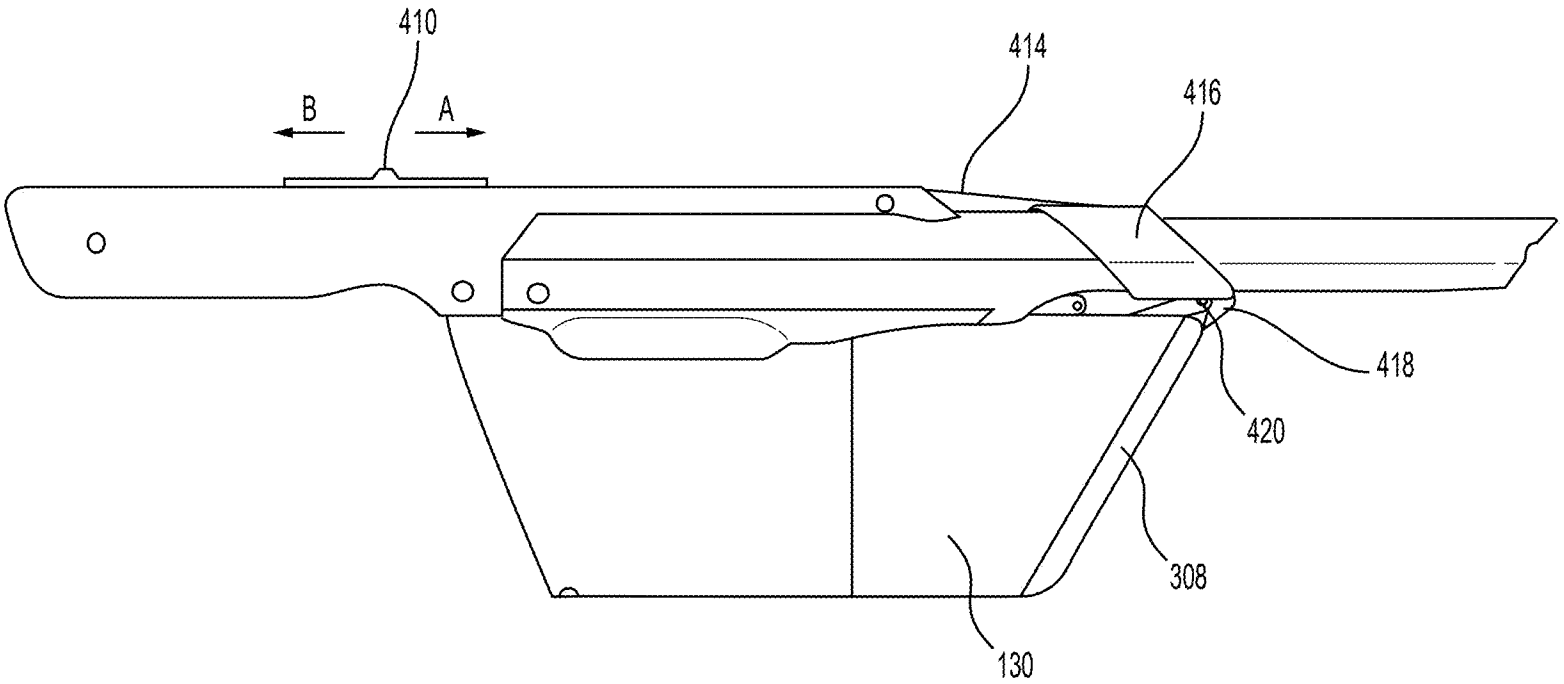
FIG. 7 shows a side a side view of a vacuum cleaner with another door mechanism.

Another embodiment of the door mechanism and actuator is shown in FIGS. 7 and 8. In this embodiment, the actuator 410 is a single slidable button. The actuator 410 is slidable between at least two positions: a first position for the suction mode and a second position for the blow mode. The actuator 410 may actuate automatic door mechanism 412. The door mechanism 412 comprises an arm 414, a collar 416 and a catch 418. The door 308 is mounted to the dust container via a hinge 420 which comprises a spring (not shown) that biases the door 308 to the open position. The arm 414 is coupled to or is formed together with the collar 416.

FIGS. 7 and 8 show the actuator and switch in the off position. An arm spring (not shown) is provided to bias the arm 414 to this position. The suction mode position is to the left of the off position and the blow mode position is to the right of the off position. When the actuator 410 is moved (in the B arrow direction) to the suction mode position, the front of the actuator 410 is disengaged with the back of arm 414 and the arm 414 remains in its position. Thus, when the actuator 410 is in the off or suction position, the arm 414 and collar 416 are biased by the arm spring such that the catch 418 pushes the door 308 to the closed position, acting against the bias of the door spring.

When the actuator 410 is slid in the direction indicated by the A arrow from the off position to the blow mode position, the front of the actuator 410 pushes (against the bias of the arm spring) the back of arm 414 so that the catch 418 moves in the same direction and disengages with the door 308, which causes the door to move to the open position due to the bias of the door spring. When the actuator 410 is pulled back from the blow mode position to the off position in the B arrow direction, the catch 418 re-engages with the door 308 and moves the door to the closed position.

The actuator 410 is coupled to a switch 422, which controls the operating mode of the vacuum cleaner. The switch 422 comprises a button 424 that is slidable between at least two positions: a first switch position which causes the fan to be driven in the suction mode and a second switch position which causes the fan to be driven in the blow mode. A third switch position for switching off the vacuum cleaner may also be provided. The actuator 410 comprises a recess which engages with the button 424 to move the button between the first and second switch positions. Since the actuator is coupled to switch 422 and is engageable with the door mechanism 412, the actuator can simultaneously actuate the suction or blow modes and the opening or closing of the door. In some embodiments, the door mechanism 302 shown in FIGS. 3 to 6 may be used with the actuator 410 of FIGS. 7 and 8.

Figure 9A:
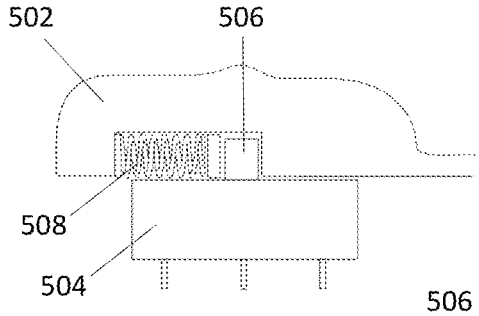
FIGS. 9A to 9C show an actuator and switch arrangement.
Figure 9B:
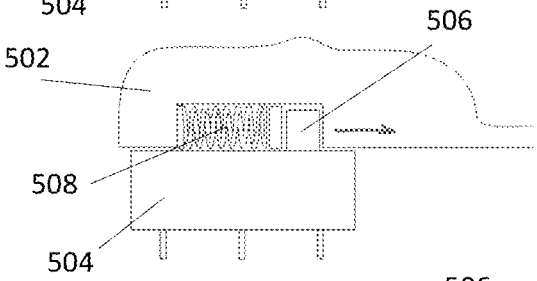
Figure 9C:
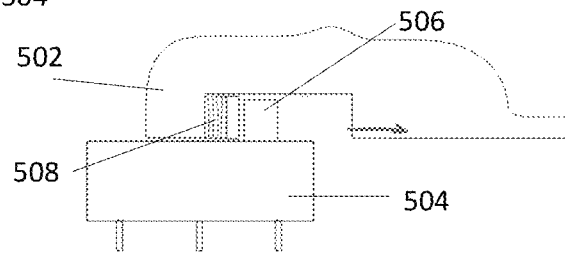

Other door opening and/or closing mechanisms may be implemented. In some cases, the door mechanism may require the arm to travel a longer distance than the switch position in order to open or close the door. For such cases, the long throw actuator shown in FIGS. 9A to 9C may be implemented. The long throw actuator comprises a slidable actuator 502 which is engageable with the door mechanism (not shown). The actuator 502 is coupled to a switch 504, which comprises a slidable button 506. The actuator comprises a recess, which receives the button 506 and a spring 508. One end of the spring 508 is mounted to a wall of the actuator recess. The other end of spring 508 is engageable with the button 506. In FIG. 9A, the button 506 is in the central off position. When the actuator 502 is moved left, a wall of the recess pushes the button to the left position for activating the suction mode. When the actuator is moved right, as shown in FIG. 9B, the spring 508 pushes the button 506 to the right position for activating the blow mode. At this position the door mechanism may slightly release the door. As shown in FIG. 9C, the user then moves the actuator 502 further to the right but the button 506 maintains it's position as the spring 508 is compressed by the further movement. This further movement allows the door mechanism to open the door fully. The actuator and switch arrangement of FIG. 9A-9C is advantageous as it allows the user to move the actuator 502 a greater distance then the throw of the switch 504.

In another example of a door opening and/or closing mechanism, a rack and pinion gear system may be implemented where the rack functions as the arm (304 or 414) in the above examples and a user or motor driven pinion moves the arm to open and close the door.

In another embodiment two or more embodiments are combined. Features of one embodiment can be combined with features of other embodiments.

Embodiments of the present invention have been discussed with particular reference to the examples illustrated. However it will be appreciated that variations and modifications may be made to the examples described within the scope of the invention.

What is claimed is:

1. A vacuum cleaner comprising:

a housing;

a fan;

an air inlet, wherein, in a suction mode, the fan operates in a first direction to generate a suction airflow from the air inlet to an air outlet so that dirt is sucked in through the air inlet; and an opening, wherein in a blow mode, the fan operates in a second direction opposite the first direction to generate a blowing airflow from the air outlet to the opening so that dirt from a dirt collection chamber is blown out of the opening, wherein the opening is greater in size than the inlet;

a cover movable between a closed position, in which the cover seals the opening, and an open position; and an actuator configured to actuate a switch for the blow mode and to actuate a mechanism for moving the cover to the open position.

2. The vacuum cleaner according to claim 1, wherein an air flow speed through the opening in the blow mode is less than an airflow speed through the inlet in the suction mode.

3. The vacuum cleaner according to claim 1, wherein a rotational speed of the fan in the suction mode is substantially the same as a rotational speed of the fan in the blow mode.

4. The vacuum cleaner according to claim 1, wherein a rotation speed of the fan in the suction mode is greater than a rotational speed of the fan in the blow mode.

5. A vacuum cleaner comprising:

a housing;

a fan;

a handle attached to the housing an air inlet;

a dirt collection chamber having an opening for emptying dirt collected in the dirt collection chamber;

a cover movable between a closed position, in which the cover seals the opening, and an open position; and an actuator configured to actuate a switch for a blow mode in which the fan generates a blowing airflow and to actuate a mechanism for moving the cover to the open position, wherein in a suction mode, the fan generates a suction airflow from the air inlet to an air outlet and in the blow mode, the fan generates a blowing airflow from the air outlet to the opening.

6. The vacuum cleaner according to claim 5, wherein the actuator is located on the handle and further configured to actuate a switch for the suction mode.

7. The vacuum cleaner according to claim 6, wherein the actuator is further configured to actuate the mechanism to move the cover to the closed position.

8. The vacuum cleaner according to claim 5, wherein the mechanism is configured to move the cover to the closed position when the blow mode is deactivated.

9. The vacuum cleaner according to claim 5, wherein the actuator is coupled to the switch and to the mechanism for moving the cover such that movement of the actuator causes both the switch and the mechanism to actuate.

10. The vacuum cleaner according to claim 5, wherein:

the switch comprises a button movable between a first switch position and a second switch position, the distance between the first and second switch positions being a first distance; and the actuator is configured to move the button between the first and second switch positions and the actuator is movable between a first actuator position and a second actuator position, the distance between the first and second actuator positions being a second distance that is greater than the first distance.

11. The vacuum cleaner according to claim 5, wherein:

the switch comprises a movable button;

the actuator is configured to move within a first range of positions which causes the button to move; and the actuator is configured to move within a second range of positions in which the button does not move.

12. The vacuum cleaner according to claim 5, wherein the size of the opening is greater than the size of the air inlet.

13. The vacuum cleaner according to claim 5, wherein the fan is an axial fan.

14. The vacuum cleaner according to claim 5, wherein the housing comprises a nozzle portion having a longitudinal axis and the fan has a rotation axis, wherein the rotation axis is offset from the longitudinal axis such that the rotation axis and the longitudinal axis are not coaxial.

* * * * *